US005605267A

United States Patent [19]

Whitten

[11] Patent Number: 5,605,267

[45] Date of Patent: Feb. 25, 1997

[54] APPARATUS FOR AUTOMATICALLY FEEDING THE END OF A WEB OF MATERIAL

[75] Inventor: David E. Whitten, Barrington, N.H.

[73] Assignees: Heidelberger Druckmaschinen AG, Heidelberg, Germany; Heidelberg Harris, Inc., Dover, N.H.

[21] Appl. No.: 437,352

[22] Filed: May 9, 1995

[51] Int. Cl.[6] ..... G03B 1/56; B41L 43/04

[52] U.S. Cl. ..... 226/91; 226/197; 270/41

[58] Field of Search ..... 226/91, 197, 116, 226/169, 171, 92; 270/40, 41, 5–9

[56] References Cited

U.S. PATENT DOCUMENTS

| | | | |
|---|---|---|---|
| 2,149,366 | 3/1939 | Seaman et al. | 270/41 X |
| 2,529,184 | 11/1950 | Pearson | 226/92 X |
| 3,165,310 | 1/1965 | Peterson | 270/41 |
| 4,154,386 | 5/1979 | Kawada | 226/91 |
| 4,187,968 | 2/1980 | Winterholler et al. | 226/197 X |
| 4,491,503 | 1/1985 | Adams et al. | 226/92 X |
| 4,619,449 | 10/1986 | Fischer | 270/5 |
| 4,686,778 | 8/1987 | Kotitschke et al. | 226/91 X |
| 4,846,417 | 7/1989 | Muller et al. | 226/92 |

FOREIGN PATENT DOCUMENTS

| | | | |
|---|---|---|---|
| 4239019 | 5/1994 | Germany | 226/171 |
| 1099623 | 1/1968 | United Kingdom . | |
| 1360584 | 7/1974 | United Kingdom . | |
| 2198712 | 6/1988 | United Kingdom . | |

*Primary Examiner*—Michael R. Mansen
*Attorney, Agent, or Firm*—Kenyon & Kenyon

[57] ABSTRACT

A device for automatically advancing the end of a web in a priming press. The device is particularly useful for advancing the web end over a former and into a folder unit in a press. The device includes at least one endless belt which moves from a retracted position to an engaged position, to thereby grip the web end and, upon rotation of the endless belt, advance the web end to the desired location in the press. The device of the present invention can also be used to advance a web end over a former roll, as well as over an angle roll, in a printing press.

15 Claims, 7 Drawing Sheets

33
34
32
1
36
2
30
35
3
31
9
25
4
40
41
8
13
15
42
18
22
6
7
24

APPARATUS FOR AUTOMATICALLY FEEDING THE END OF A WEB OF MATERIAL

BACKGROUND OF THE INVENTION

1. Field of the Invention

The present invention relates to an apparatus for automatically feeding an end of a web of material into an element in a printing press. In particular, the present invention relates to an apparatus for automatically feeding the end of a web of paper over a former and into a folder for ribbons in a printing press.

2. Discussion of the Prior Art

It is known to provide a former for feeding a web of paper into a folder for folding the web in half or into sections. Once the end of the web has been fed into the folder, the former automatically directs the length of the web through the folder. However, in the past, placing the end of the web into the folder has required that the end be manually fed over the former and into the folder. Such manual feeding of the web end over the former and into the folder can be difficult and time-consuming, thereby decreasing the efficiency of the overall operation of the press. Manual feeding of a web end into a folder can also increase the safety risks to the press operator who must manually feed the web end.

SUMMARY OF THE INVENTION

The present invention is an apparatus for automatically advancing the end of a web of material. In particular, the present invention is an apparatus for automatically advancing the end of a web of material over a former and into a folder in a printing press. The device of the present invention can also be used to allow automatic feeding of the end of a web of material to a former over a former roll, or can be used to automatically feed the end of a web of material over an angle bar. The invention includes at least one endless belt made of a resilient material which, when it is desired to feed the end of the web, is extended so as to engage the web end. In the engaged position, the belt rotates to thereby advance the web end. After the web end has been fed to the desired location, the endless belt is retracted, and the web can thereafter be advanced normally without any interference from the endless belt.

Several different embodiments, which can be used alone or in combination, are possible within the teachings of the present invention. The apparatus can be used to advance the web end from the former to the folder, can be used to advance the web end onto the former, or alternatively can be used to advance a web end over an angle bar.

BRIEF DESCRIPTION OF THE DRAWINGS

The foregoing and other features of the present invention will become apparent to those skilled in the art, upon reading the following description of preferred embodiments of the invention, in view of the accompanying drawings, wherein.

DESCRIPTION OF PREFERRED EMBODIMENTS

Figure 1:
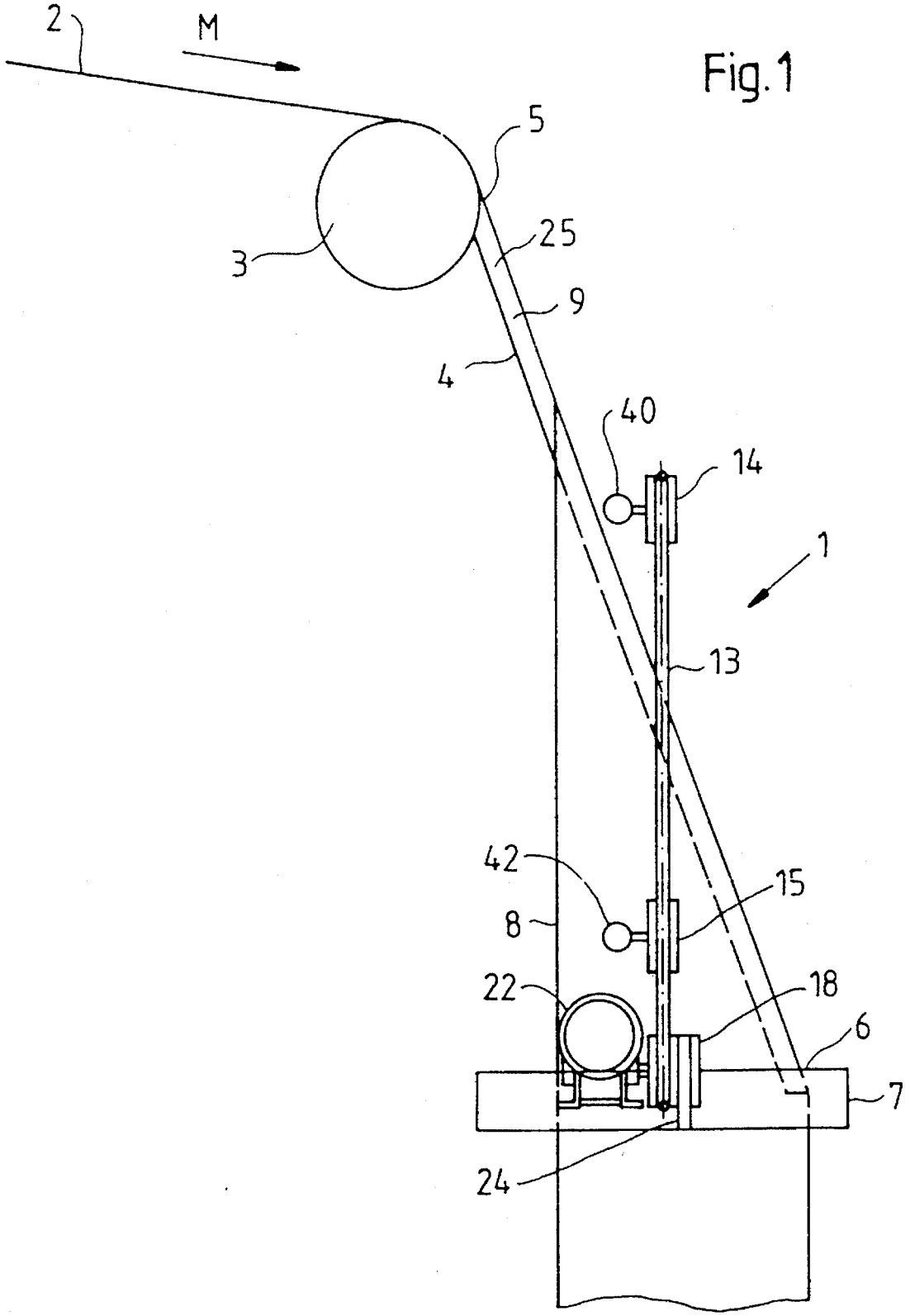
FIG. 1 shows a side view of a first embodiment of the present invention.
Figure 2:
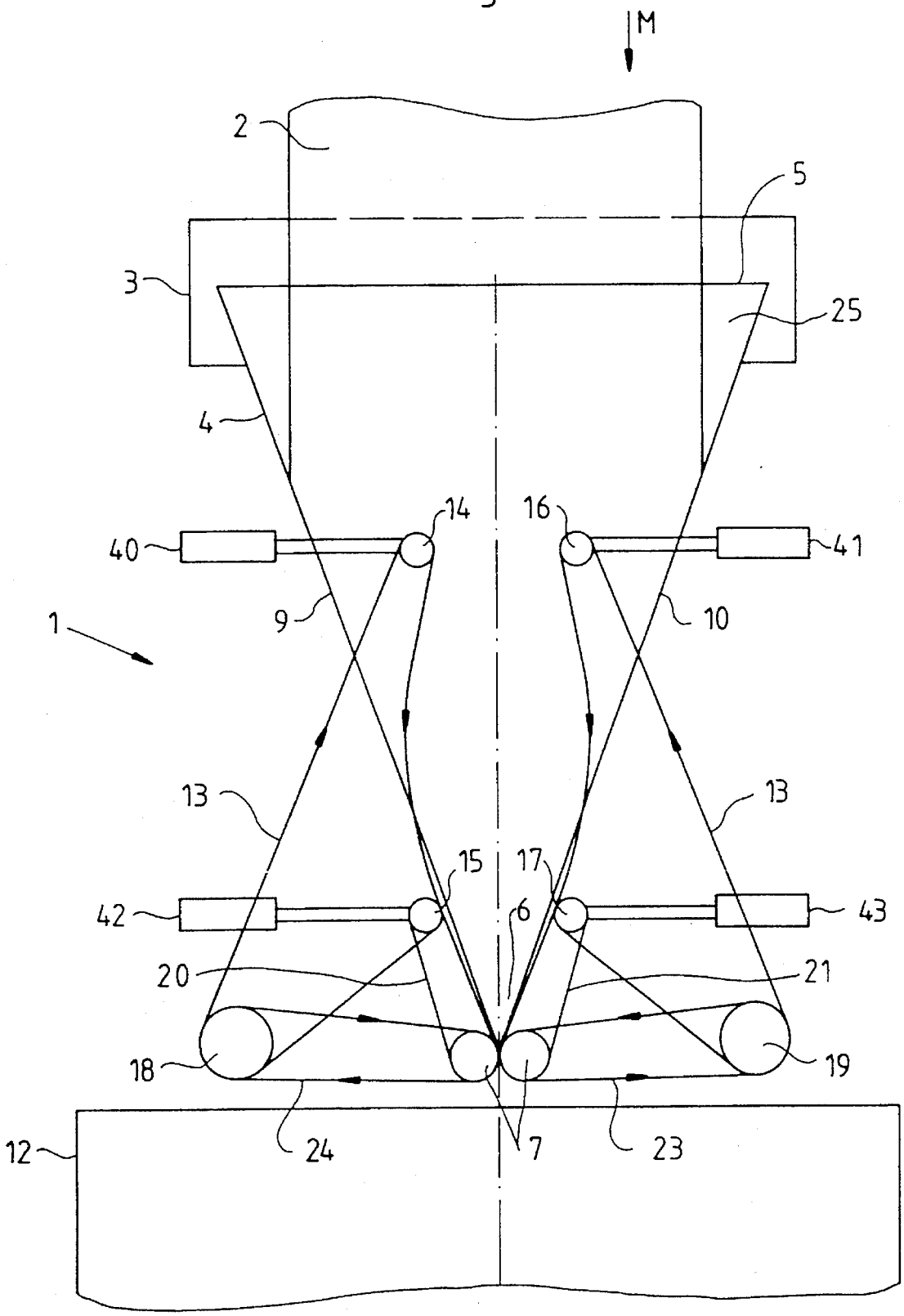
FIG. 2 shows a front view of the embodiment of FIG. 1, with the feeding belts in an engaged position.
Figure 3:
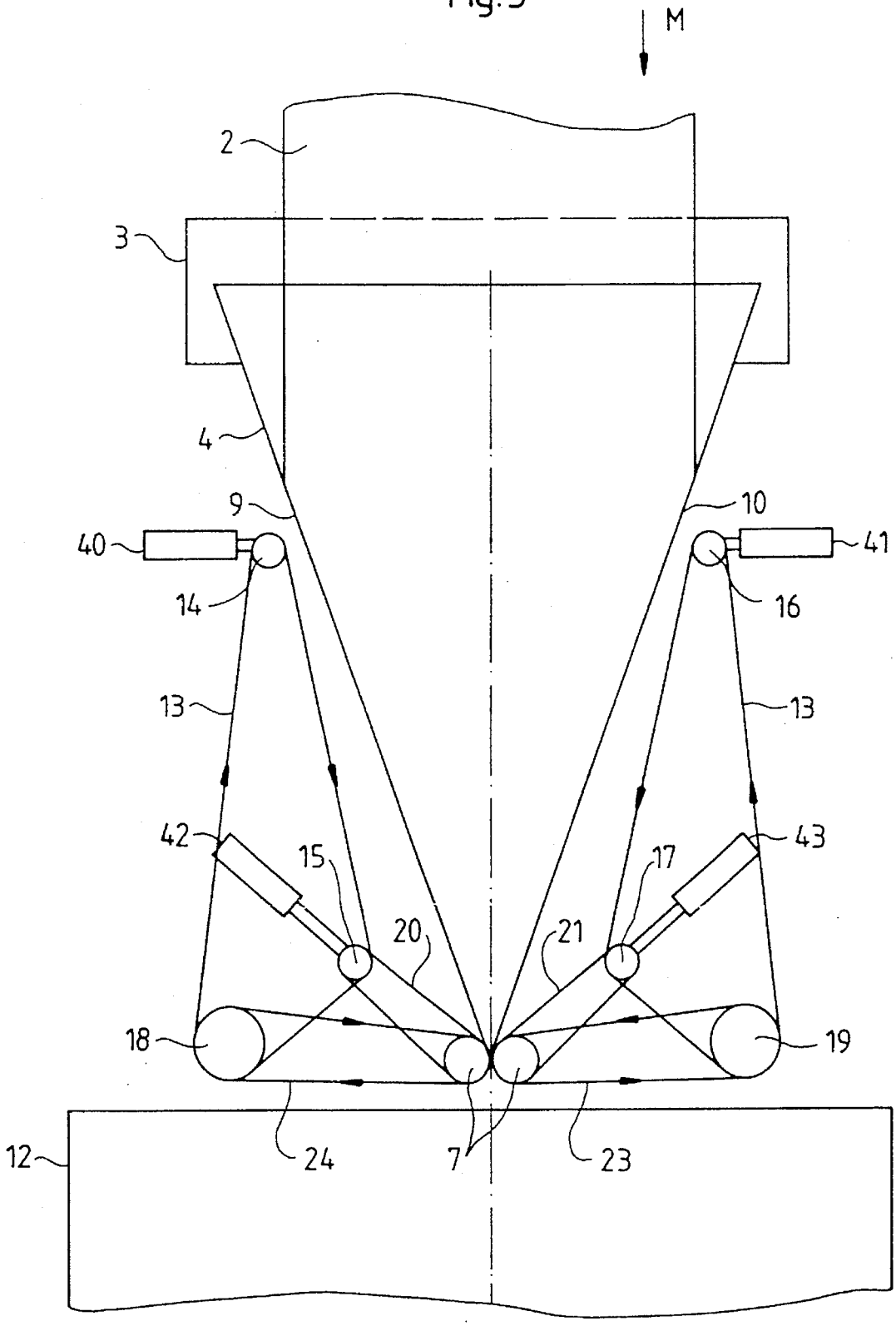
FIG. 3 shows a front view of the embodiment of FIG. 1, with the feeding belts in a retracted position.

FIGS. 1 and 2–3 show side and from views of a web former and folder including a first embodiment of the apparatus 1 of the present invention. A web 2 of sheet material is shown in FIGS. 1–3 being passed over a former roll 3, which former roll 3 guides the web 2 to a former 4. Web 2 advances in the direction of arrow M in FIGS. 1 and 2. As shown in FIG. 2, the former 4 is a triangular-shaped plate with its base 5 located closely adjacent former roll 3 and with its apex 6 located closely adjacent form rolls 7. As can be seen in FIG. 1, sides 8 of web 2 wrap over sides 9, 10 of former 4, such that at apex 6, the web 2 is folded in half. The web then passes through form rolls 7 and subsequently through nip rolls (not shown), such that the web is conveyed through the folder 12 as a folded web.

Adjacent to, and on either side of, former 4 are advancing belts 13. Advancing belts 13 are preferably constructed of a resilient, elastomeric material and are formed as an endless loop, preferably with a circular cross-section. Advancing belts 13 are entrained across pulleys 14, 15 and 16, 17, respectively, as well as driven pulleys 18, 19, respectively. Pulleys 14 and 16 are mounted for reciprocal movement (compare FIGS. 2 and 3), and are moved from an engaged position (FIG. 2) to a retracted position (FIG. 3) by suitable driving devices 40, 41, e.g., hydraulic or pneumatic pistons, solenoids or motors with lead screws. Pulleys 15 and 17 are mounted on rotating arms 20, 21, respectively. Rotating arms 20, 21 are mounted for rotary movement (compare FIGS. 2 and 3), and are moved from an engaged position (FIG. 2) to a retracted position (FIG. 3) by suitable driving devices 42, 43, e.g., hydraulic or pneumatic pistons, solenoids or motors with lead screws. Suitable motors 22, through appropriate gear trains, drive driven pulleys 18, 19 to thereby rotate advancing belts 13 in the directions indicated by the arrowheads in FIGS. 2 and 3. Pulleys 14, 15, 16, 17, 18, 19 are generally constructed as deeply-grooved pulleys, to thereby provide protection against the advancing belts 13 "jumping" out of the pulleys 14, 15, 16, 17, 18, 19 as a result of contact of the advancing belts 13 with the web 2 and the angled edges 9, 10 of former 4.

FIG. 2 shows the advancing belts 13 in an engaged position, in which the advancing belts 13 advance the web 2 over the former 4 and down through the form rolls 7. In this position, the outer surface of advancing belts 13 contact the web 2 at the edges 9, 10 of former 4 and upon rotation of advancing belts 13 in the direction of the arrowheads, the web 2 is pulled downwardly over former 4 and pushed in between form rolls 7. Form rolls 7, which are rotated, through form roll belts 24, 23, by motors 22, along with the rotation of advancing belts 13, push the web through form rolls 7 and into the folder apparatus 12. Roll belts 24, 23, can be in the form of a flat belt or any other suitable belt for driving form rolls 7 from the rotation of driven pulleys 18, 19.

In operation of the device of FIGS. 1–3, the apparatus is initially in the position indicated in FIG. 3, with the advancing belts 13 retracted, except that the web of material is not on the former 4 as shown in FIG. 3. The web 2 is fed through the press in the direction M so that it advances over former roll 3 and down over the flat upper surface 25 of former 4. After an end of the web 2 has passed a position at which it is forward of advancing belts 13 (i.e., between advancing belts 13 and form rolls 7), the pulleys 14, 15, 16, 17 are moved to the positions shown in FIG. 2. In this position, the advancing belts 13 press the sides 8 of the web 2 against the sides 9, 10 of the former 4, and rotation of the advancing belts 13 in the direction of the arrowheads pulls the web 2 downwardly until the end of the web 2 is placed between form rolls 7. Form rolls 7, which are driven by motors 22 through roll belts 24, 23, thereafter contact the web 2 to push the web 2 through the form rolls 7 and into the folder 12. After the end of the web 2 has passed through the form rolls 7 and subsequently through nip rolls (not shown), the advancing mechanism 1 can be placed in the retracted position shown in FIG. 3, in which the belts 13 are retracted away from the web 2 by moving pulleys 14, 15, 16, 17 away from the web 2. In this position, the form rolls 7 and the components of the folder 12 are sufficient to continue the advance of web 2 in the direction M.

The engagement and retraction of the belts 13 shown in FIGS. 2 and 3 can be accomplished in several different ways. First, a press operator can initiate the engagement and retraction motions in response to visual observation of the position of the end of web 2 along the former 4. Furthermore, sensors, such as photosensors or any other equivalent sensor, could be used to detect the position of the end of the web 2 along the former 4, and signals from these sensors could be used to automatically initiate movement of the belts 13 from or to the positions shown in FIGS. 2 and 3.

Figure 4:
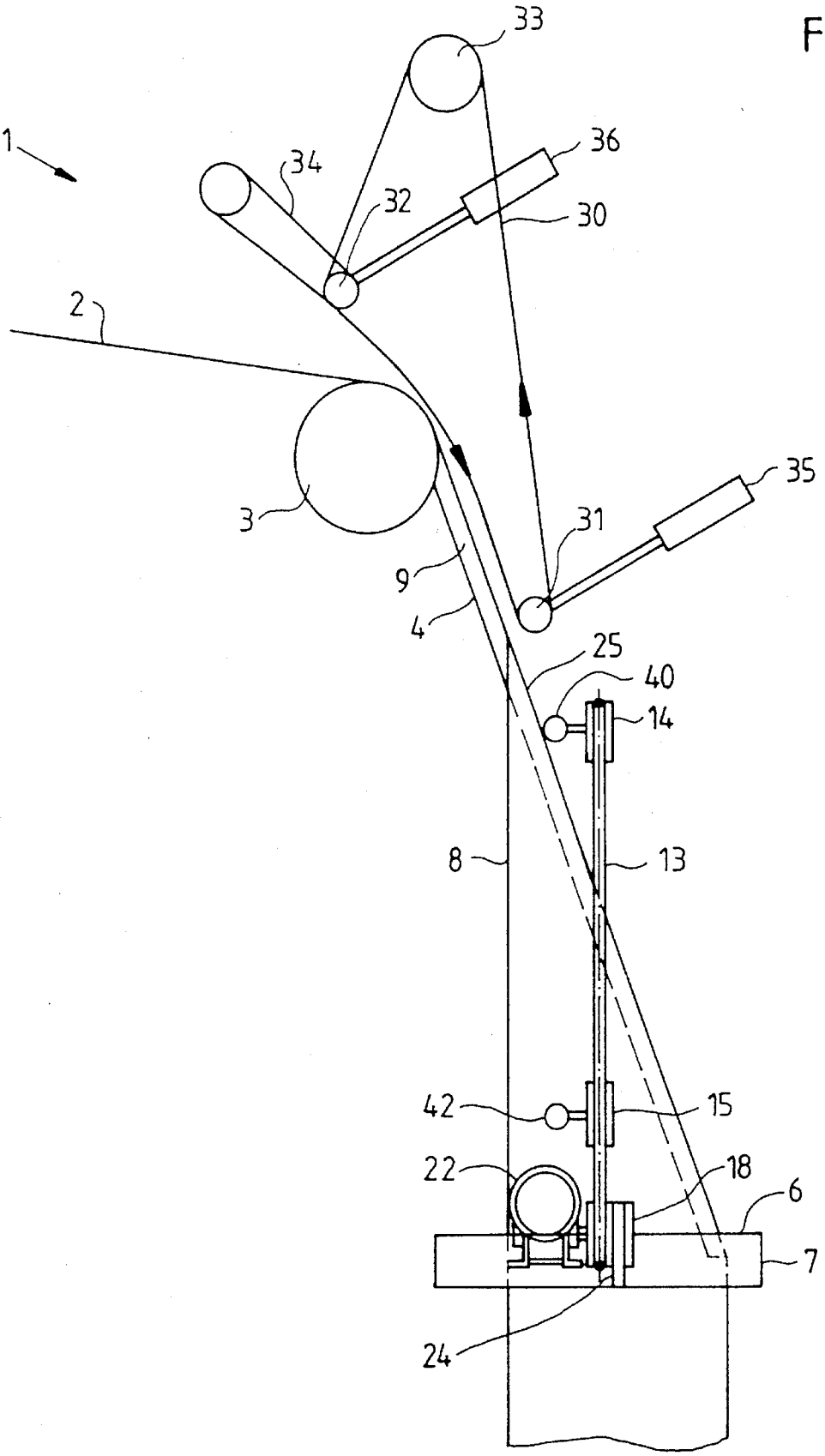
FIG. 4 shows a second embodiment of the present invention, with a feeding belt in an engaged position.
Figure 5:
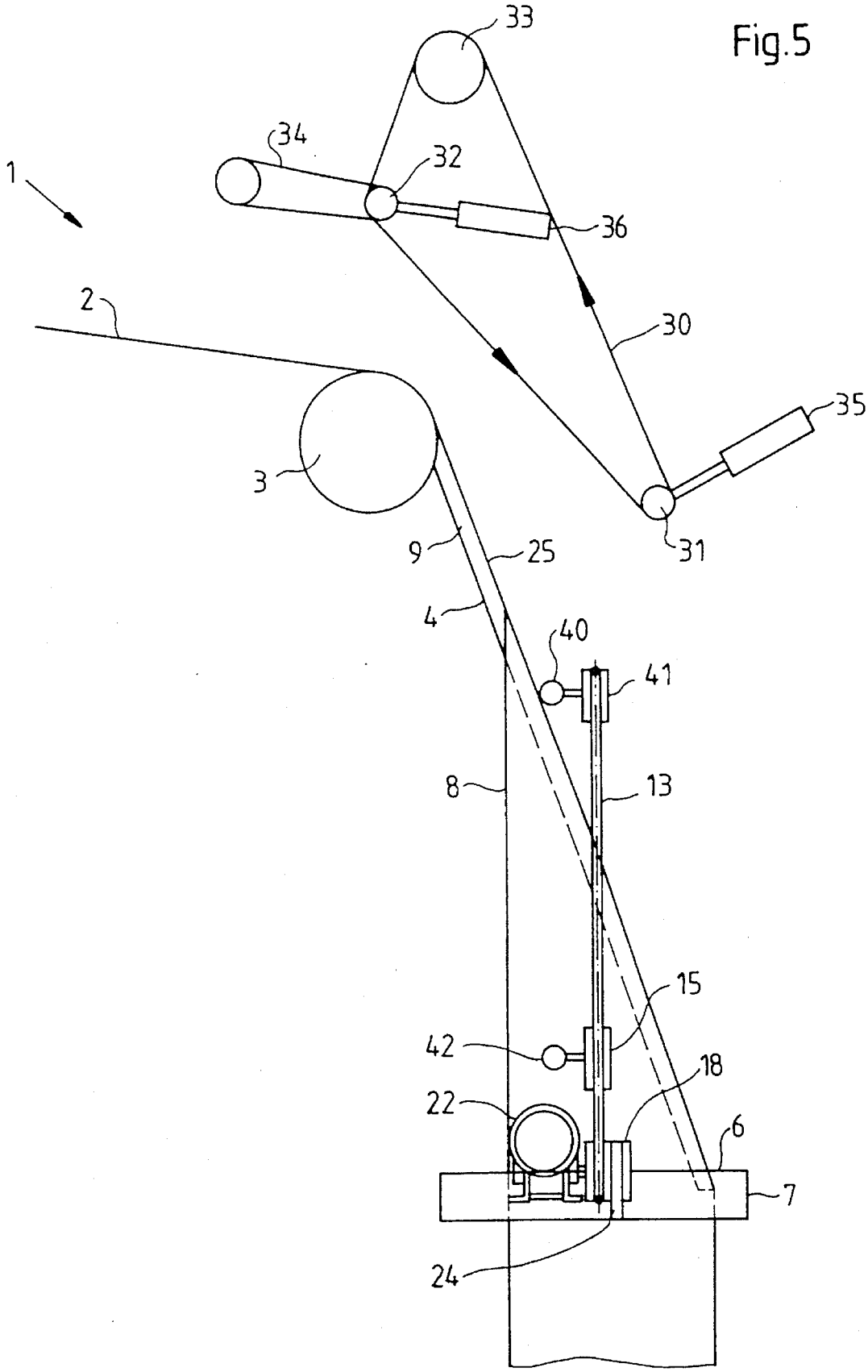
FIG. 5 shows a second embodiment of the present invention, with a feeding belt in a retracted position.

FIG. 4 shows a second embodiment of the present invention, similar in design in operation to the embodiment of FIGS. 1–3, but which includes an additional belt 30 for advancing the web 2 over the former roll 3 and onto the former 4. The structure and operation of the additional belt 30 is very similar to the belts 13 used for advancing the end of the web 2 over the former 4 and into the folder 12. The belt 30 is entrained over pulleys 31 and 32, which pulleys may be placed in an engagement position (FIG. 4) or a retracted position (FIG. 5). The belt 30 is also entrained over a driven pulley 33, which is driven by any suitable device for rotating the belt 30 in the direction of the arrowheads, e.g., a motor with a suitable gear train. Pulley 31 is mounted for reciprocal movement (compare FIGS. 4 and 5), and is moved from an engaged position (FIG. 4) to a retracted position (FIG. 5) by a suitable driving device 35, e.g., hydraulic or pneumatic pistons, solenoids or motors with lead screws. Pulley 32 is mourned on a rotating arm 34. Rotating arm 34 is mourned for rotary movement (compare FIGS. 4 and 5), and is moved from an engaged position (FIG. 4) to a retracted position (FIG. 5) by a suitable driving device 36, e.g.. hydraulic or pneumatic pistons, solenoids or motors with lead screws.

In operation of the device of FIGS. 4 and 5, the apparatus 1 is initially in the position indicated in FIG. 4, with the advancing belt 30 in the engaged position, except that the web of material is not on the former 4 as shown in FIG. 4. The web 2 is fed through the press in the direction M, and as it approaches former roll 3, the belt 30 engages the web and because belt 30 is rotating in the direction indicated by the arrowheads, the belt 30 advances the web 2 over former roll 3 and the upper surface 25 of the former 4. After an end of the web 2 has passed a position at which it is forward of advancing belts 13 (i.e., between advancing belts 13 and form rolls 7), the pulleys 31, 32 are moved to the positions shown in FIG. 5. In this position, the belts 13 are operated in the manner described above, to thereby advance the end of the web 2 into the folder 12 through form rolls 7.

Figure 6:
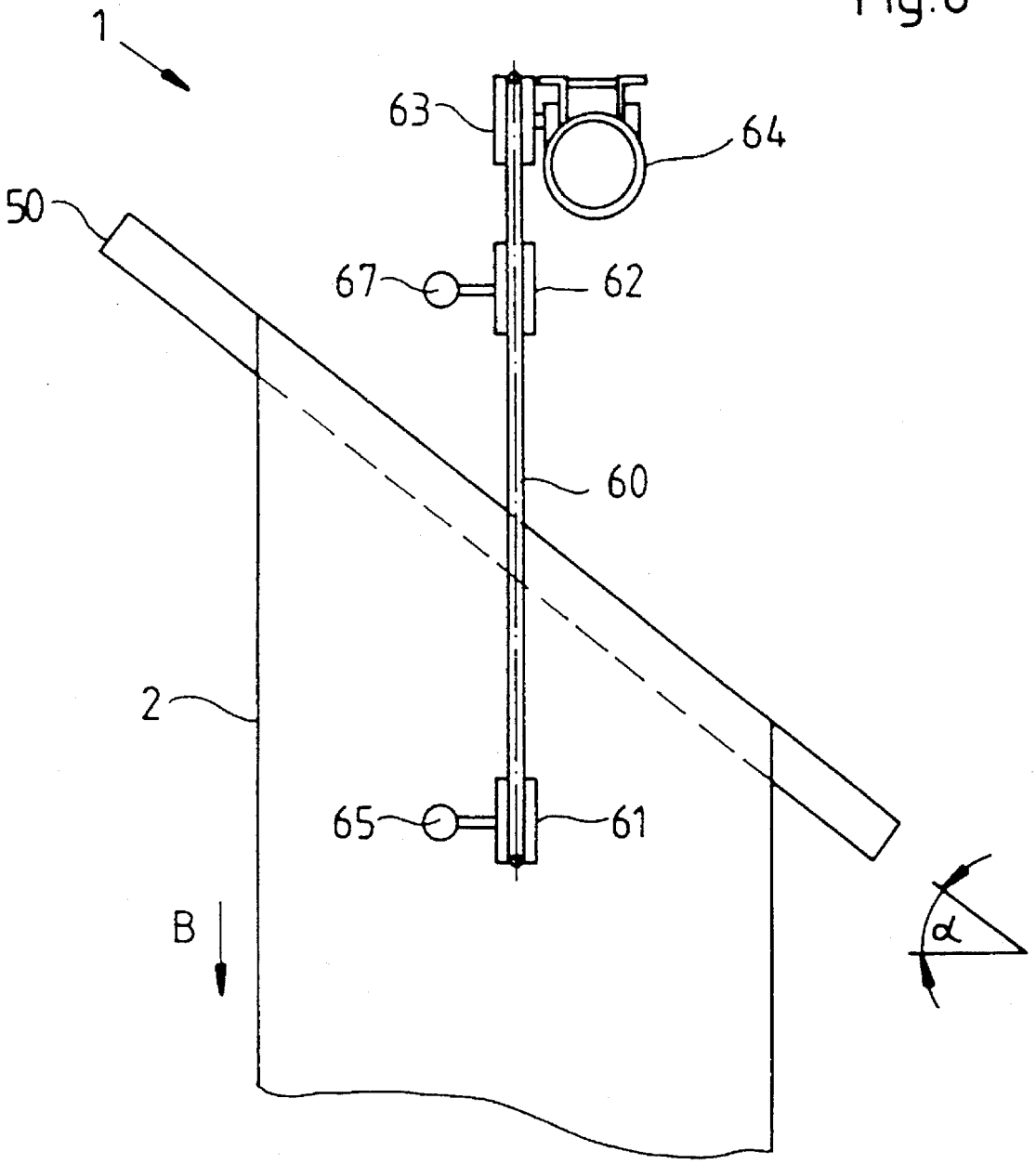
FIG. 6 shows a side view of a third embodiment of the present invention, used for feeding a web of material over an angle bar.
Figure 7:
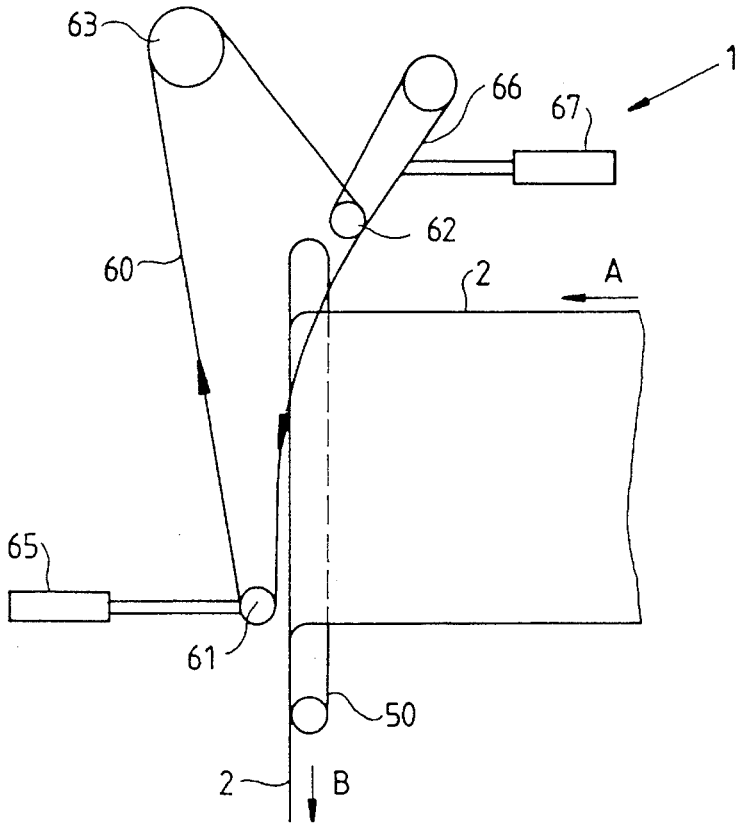
FIG. 7 shows a front view of the embodiment of FIG. 6, with the feeding belt in an engaged position.
Figure 8:
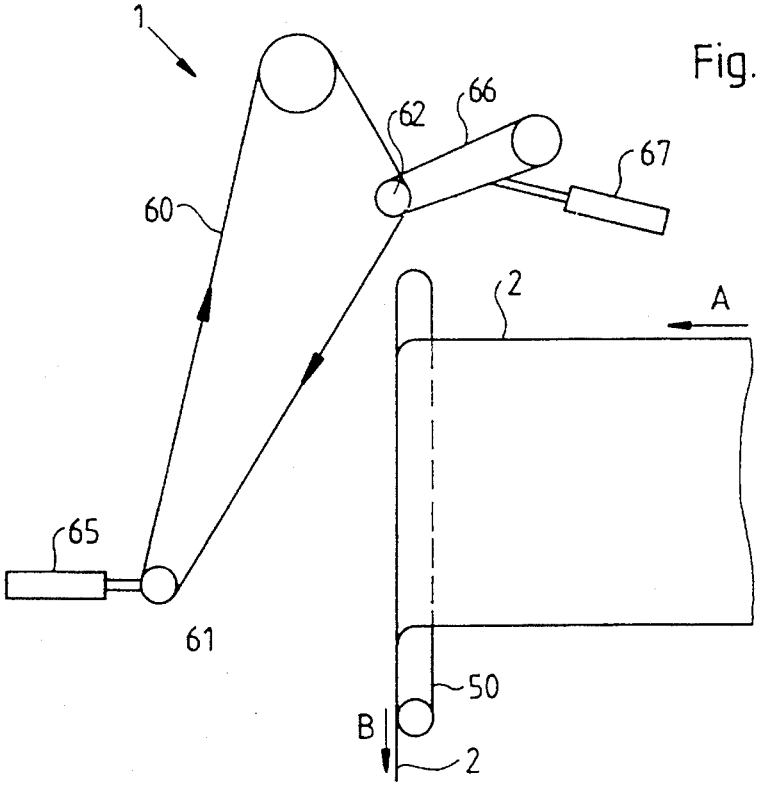
FIG. 8 shows a front view of the embodiment of FIG. 6, with the feeding belt in a retracted position.

FIGS. 6–8 show an embodiment of the present invention in which the automatic feeding apparatus 1 is used to feed a web 2 of material over an angle bar 50. Angle bar 50 is a rotating roller or a fixed bar oriented at an angle a, generally 45°. Angle bar 50 allows the web 2 to change directions from a first direction A to a second direction B. In order to allow the automatic feeding of web 2 over angle bar 50, the belt 60 is entrained over pulleys 61 and 62, which pulleys may be placed in an engagement position (FIG. 7) or a retracted position (FIG. 8). The belt 60 is also entrained over a driven pulley 63, which is driven by any suitable device 64 for rotating the belt 60 in the direction of the arrowheads, e.g., a motor with a suitable gear train. Pulley 61 is mounted for reciprocal movement (compare FIGS. 7 and 8), and is moved from an engaged position (FIG. 7) to a retracted position (FIG. 8) by a suitable driving device 65, e.g., hydraulic or pneumatic pistons, solenoids or motors with lead screws. Pulley 62 is mounted on a rotating arm 66. Rotating arm 66 is mounted for rotary movement (compare FIGS. 7 and 8), and is moved from an engaged position (FIG. 7) to a retracted position (FIG. 8) by a suitable driving device 67, e.g., hydraulic or pneumatic pistons, solenoids or motors with lead screws.

In operation of the device of FIGS. 6–8, the apparatus 1 is initially in the position indicated in FIG. 7, with the advancing belt 60 in the engaged position, except that the web 2 of material is not on the angle bar 50 as shown in FIG. 8. The web 2 is fed through the press in the direction A, and as it approaches angle bar 50, the belt 60 engages the web 2 and because belt 60 is rotating in the direction indicated by the arrowheads, the belt 60 advances the web 2 over angle bar 50 into the direction B. After the web 2 has advanced over the angle bar 50, the belt 60 is moved to the position of FIG. 8.

The present invention contemplates a number of different variations on the above-described preferred embodiment. For example, the movable pulleys on which the advancing belts are entrained could both be mounted on a single plate or frame, which plate or frame could be moved from the engaged to the retracted positions, and vice versa, with a single actuating device. It is to be understood that the above description is only of one preferred embodiment, and the scope of the invention is to be measured by the claims below.

I claim:

1. An apparatus for feeding a web into a folder comprising:

a former, said web being capable of passing over said former;

at least one endless belt;

at least one pulley, said at least one endless belt being entrained over said at least one pulley, said at least one pulley being movable from a first position to a second position;

a pulley moving device for moving said at least one pulley from said first position of said at least one pulley to said second position of said at least one pulley, said pulley moving device moving said at least one pulley so that at said first position of said at least one pulley, said at least one endless belt engages a portion of said web on said former and in said second position of said at least one pulley, said at least one endless belt does not engage said web; and a belt moving device for moving said at least one endless belt over said at least one pulley, movement of said at least one endless belt over said at least one pulley, when said at least one pulley is in said first position of said at least one pulley, thereby advancing said web over said former.

2. The apparatus of claim 1, further comprising:

at least two form rolls, said web passing through said form rolls after passing over said former.

3. The apparatus of claim 2, wherein:

said belt moving device also rotates at least one of said form rolls.

4. The apparatus of claim 1, further comprising:

an additional pulley, said at least one endless belt being entrained over said additional pulley, said additional pulley being movable from a first position to a second position, wherein at said first position of said additional pulley, said at least one endless belt engages a portion of said web on said former and in said second position of said second pulley, said at least one endless belt does not engage said web.

5. The apparatus of claim 4, further comprising:

an additional pulley moving device for moving said additional pulley from said first position of said additional pulley to said second position of said additional pulley.

6. The apparatus of claim 5, further comprising:

a rotatable arm, said additional pulley being mounted on said rotatable arm, said additional pulley moving device rotating said rotatable arm.

7. The apparatus of claim 1, further comprising:

a second endless belt, said at least one endless belt being located on one side of said former and said second endless belt being located on an opposite side of said former;

a first pulley, said second endless belt being entrained over said first pulley, said first pulley being movable from a first position to a second position;

a first pulley moving device for moving said first pulley from said first position of said first pulley to said second position of said first pulley, said first pulley moving device moving said first pulley so that at said first position of said first pulley, said second endless belt engages a portion of said web on said former and in said second position of said first pulley, said second endless belt does not engage said web; and a second belt moving device for moving said second endless belt over said first pulley, movement of said second endless belt over said first pulley, when said first pulley is in said first position of said first pulley, thereby advancing said web over said former.

8. The apparatus of claim 7, further comprising:

at least two form rolls, said web passing through said form rolls after passing over said former.

9. The apparatus of claim 8, wherein:

said belt moving device also rotates one of said form rolls, and said second belt moving device also rotates another of said form rolls.

10. The apparatus of claim 7, further comprising:

a second additional pulley, said second endless belt being entrained over said second additional pulley, said second additional pulley being movable from a first position to a second position, wherein at said first position of said second additional pulley, said second endless belt engages a portion of said web on said former and in said second position of said second additional pulley, said second belt does not engage said web.

11. The apparatus of claim 10, further comprising:

a second additional pulley moving device for moving said second additional pulley from said first position of said second additional pulley to said second position of said second additional pulley.

12. The apparatus of claim 11, further comprising:

a rotatable arm, said second additional pulley being mounted on said rotatable arm, said second additional pulley moving device rotating said rotatable arm.

13. The apparatus of claim 1, further comprising:

a former roll, said web passing over said former roll before passing over said former;

a second endless belt;

a second pulley, said second endless belt being entrained over said second pulley, said second pulley being movable from a first position to a second position;

a second pulley moving device for moving said second pulley from said first position of said second pulley to said second position of said second pulley, said second pulley moving device moving said second pulley so that at said first position of said second pulley, said second endless belt engages said web as it passes over said former roll and in said second position of said second pulley, said second endless belt does not engage said web; and a second belt moving device for moving said second endless belt over said second pulley.

14. An apparatus for feeding a web into a folder comprising:

a former, said web passing over said former;

a former roll, said web passing over said former roll before passing over said former;

an endless belt;

a pulley, said endless belt being entrained over said pulley, said pulley being movable from a first position to a second position;

a pulley moving device for moving said pulley from said first position of said pulley to said second position of said pulley, said pulley moving device moving said pulley so that at said first position of said pulley, said endless belt engages said web as it passes over said former roll and in said second position of said pulley, said endless belt does not-engage said web; and a belt moving device for moving said endless belt over said pulley.

15. An apparatus for feeding a web into a folder comprising:

a former, said web passing over said former;

a former roll, said web passing over said former roll before passing over said former;

a first endless belt;

a first pulley, said first endless belt being entrained over said first pulley, said first pulley being movable from a first position to a second position;

a first pulley moving device for moving said first pulley from said first position of said first pulley to said second position of said first pulley, said first pulley moving device moving said first pulley so that at said first position of said first pulley, said first endless belt engages said web as it passes over said former roll and in said second position of said first pulley, said first endless belt does not engage said web;

a first moving device for moving said first endless belt over said first pulley;

a second endless belt located on one side of said former;

a second pulley, said second endless belt being entrained over said second pulley, said second pulley being movable from a first position to a second position;

a second pulley moving device for moving said second pulley from said first position of said second pulley to said second position of said second pulley, said second pulley moving device moving said second pulley so that at said first position of said second pulley, said second endless belt engages said web as it passes over said former and in said second position of said second pulley, said second endless belt does not engage said web;

a second moving device for moving said second endless belt over said second pulley;

a third endless belt located on another side of said former;

a third pulley, said third endless belt being entrained over said third pulley, said third pulley being movable from a first position to a second position;

a third pulley moving device for moving said third pulley from said first position of said third pulley to said second position of said third pulley, said third pulley moving device moving said third pulley so that at said first position of said third pulley, said third endless belt engages said web as it passes over said former and in said second position of said third pulley, said third endless belt does not engage said web;

a third moving device for moving said third endless belt over said third pulley.

* * * * *